US007178599B2

(12) United States Patent
Anderson et al.

(10) Patent No.: US 7,178,599 B2
(45) Date of Patent: Feb. 20, 2007

(54) SUBSURFACE SAFETY VALVE

(75) Inventors: Robert J. Anderson, Aberdeen (GB); Nathaniel H. Wagner, Spring, TX (US); Roddie R. Smith, Cypress, TX (US); John Hanton, Jakarta (ID)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/366,593

(22) Filed: Feb. 12, 2003

(65) Prior Publication Data

US 2004/0154803 A1 Aug. 12, 2004

(51) Int. Cl.
*E21B 34/12* (2006.01)
*E21B 43/16* (2006.01)

(52) U.S. Cl. ..... 166/332.8; 166/386; 166/373; 166/317

(58) Field of Classification Search ..... 166/332.8, 166/319, 373, 374, 375, 317, 323, 386
See application file for complete search history.

(56) References Cited

U.S. PATENT DOCUMENTS

| | | | | | |
|---|---|---|---|---|---|
| 2,998,077 | A | * | 8/1961 | Keithahn | 166/323 |
| 3,749,119 | A | * | 7/1973 | Tausch et al. | 137/461 |
| 3,763,932 | A | * | 10/1973 | Dinning | 166/322 |
| 4,077,473 | A | * | 3/1978 | Watkins | 166/323 |
| 4,160,484 | A | * | 7/1979 | Watkins | 166/317 |
| 4,420,041 | A | * | 12/1983 | Patel | 166/278 |
| 4,597,445 | A | | 7/1986 | Knox | |
| 4,605,070 | A | * | 8/1986 | Morris | 166/380 |
| 4,651,827 | A | * | 3/1987 | Helderle et al. | 166/317 |
| 4,846,281 | A | * | 7/1989 | Clary et al. | 166/373 |
| 4,890,674 | A | * | 1/1990 | Le | 166/319 |
| 5,125,457 | A | | 6/1992 | Meaders | |
| 5,145,005 | A | * | 9/1992 | Dollison | 166/332.8 |
| 5,167,284 | A | | 12/1992 | Leismer | 166/374 |
| 5,249,630 | A | | 10/1993 | Meaders et al. | 166/373 |
| 5,343,955 | A | | 9/1994 | Williams | 166/386 |

(Continued)

FOREIGN PATENT DOCUMENTS

| | | |
|---|---|---|
| GB | 2213181 | 8/1989 |

(Continued)

OTHER PUBLICATIONS

U.K. Search Report, Application No. GB0403024.3, dated May 28, 2004.

(Continued)

*Primary Examiner*—Kenneth Thompson
(74) *Attorney, Agent, or Firm*—Patterson & Sheridan, LLP

(57) ABSTRACT

A subsurface safety valve assembly for controlling fluid flow in a wellbore. In one embodiment, the subsurface safety valve assembly includes a tubular member having a longitudinal bore extending therethrough, a flapper removably connected to the tubular member. The flapper is configured to pivot against the tubular member between an open position and a closed position. The subsurface safety valve assembly further includes a flow tube disposed inside the tubular member and a shear sleeve having an upper end and a lower end. The upper end of the shear sleeve is positioned against a lower end of the flow tube to form a first seal between the upper end of the shear sleeve and the lower end of the flow tube.

30 Claims, 7 Drawing Sheets

U.S. PATENT DOCUMENTS

| | | | |
|---|---|---|---|
| 5,358,053 | A | 10/1994 | Akkerman |
| 6,263,910 | B1 | 7/2001 | Davis et al. |
| 2002/0000317 | A1 | 1/2002 | Rayssigular et al. |

FOREIGN PATENT DOCUMENTS

| | | |
|---|---|---|
| WO | WO 99/14461 | 3/1999 |
| WO | WO 2004/022906 | 3/2004 |

OTHER PUBLICATIONS

U.K. Search Report, Application No. GB0403024.3, dated Oct. 5, 2004.

* cited by examiner

SUBSURFACE SAFETY VALVE

BACKGROUND OF THE INVENTION

1. Field of the Invention

Embodiments of this invention are generally related to safety valves. More particularly, embodiments of this invention pertain to subsurface safety valves configured to control fluid flow through a production tubing string.

2. Description of the Related Art

Surface-controlled, subsurface safety valves (SCSSVs) are commonly used to shut in oil and gas wells. Such SCSSVs are typically fitted into a production tubing in a hydrocarbon producing well, and operate to block the flow of formation fluid upwardly through the production tubing should a failure or hazardous condition occur at the well surface.

SCSSVs are typically configured as rigidly connected to the production tubing (tubing retrievable), or may be installed and retrieved by wireline, without disturbing the production tubing (wireline retrievable). During normal production, the subsurface safety valve is maintained in an open position by the application of hydraulic fluid pressure transmitted to an actuating mechanism. The hydraulic pressure is commonly supplied to the SCSSV through a control line which resides within the annulus between the production tubing and a well casing. The SCSSV provides automatic shutoff of production flow in response to one or more well safety conditions that can be sensed and/or indicated at the surface. Examples of such conditions include a fire on the platform, a high/low flow line pressure condition, a high/low flow line temperature condition, and operator override. These and other conditions produce a loss of hydraulic pressure in the control line, thereby causing the flapper to close so as to block the flow of production fluids up the tubing.

Most surface controlled subsurface safety valves are "normally closed" valves, i.e., the valves utilize a flapper type closure mechanism biased in its closed position. In many commercially available valve systems, the bias is overcome by longitudinal movement of a hydraulic actuator. In some cases the actuator of the SCSSV includes a concentric annular piston. Most commonly, the actuator includes a small diameter rod piston, located in a housing wall of the SCSSV.

During well production, the flapper is maintained in the open position by a flow tube down hole to the actuator. From a reservoir, a pump at the surface delivers regulated hydraulic fluid under pressure to the actuator through a control conduit, or control line. Hydraulic fluid is pumped into a variable volume pressure chamber (or cylinder) and acts against a seal area on the piston. The piston, in turn, acts against the flow tube to selectively open the flapper member in the valve. Any loss of hydraulic pressure in the control line causes the piston and actuated flow tube to retract, which causes the SCSSV to return to its normally closed position by a return means. The return means serves as the biasing member, and typically defines a powerful spring and/or gas charge. The flapper is then rotated about a hinge pin to the valve closed position by the return means, i.e., a torsion spring, and in response to upwardly flowing formation fluid.

In recent completion techniques, an SCSSV may be run with the production tubing into the hole prior to a cementing operation. Once the cement is cured, the desired formations are perforated through the tubing. Using this technique, however, exposes the SCSSV to the cement during the cementing operation, which may cause the SCSSV to fail prematurely.

Therefore, a need exists for an apparatus and method for protecting the SCSSV from cement infiltrating the SCSSV during the cementing operation.

SUMMARY OF THE INVENTION

Various embodiments of the present invention are generally directed to a subsurface safety valve assembly for controlling fluid flow in a welibore. In one embodiment, the subsurface safety valve assembly includes a tubular member having a longitudinal bore extending therethrough and a flapper removably connected to the tubular member. The flapper is configured to pivot against the tubular member between an open position and a closed position. The subsurface safety valve assembly further includes a flow tube disposed inside the tubular member and a shear sleeve having an upper end and a lower end. The upper end of the shear sleeve is positioned against a lower end of the flow tube to form a first seal between the upper end of the shear sleeve and the lower end of the flow tube.

Various embodiments of the present invention are also directed to a system for protecting well completion equipment from at least one of cement or fluids during a cementing operation. In one embodiment, the system includes a sleeve removably disposed inside the well completion equipment and a dart configured to pull the sleeve away from the well completion equipment after the cementing operation is complete.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
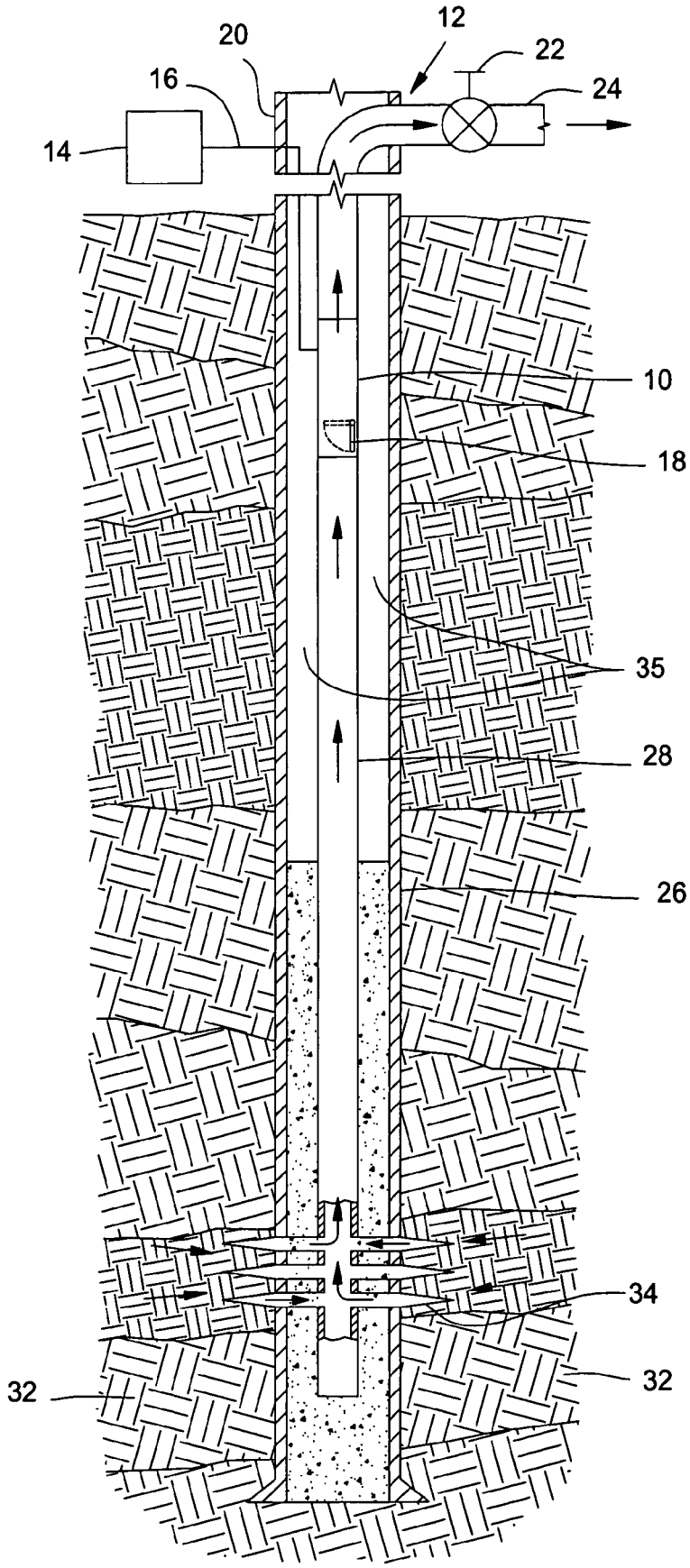
FIG. 1 illustrates a schematic of a production well having a subsurface safety valve installed in accordance with an embodiment of the invention.

A detailed description will now be provided. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features of the invention. One of normal skill in the art of subsurface safety valves will appreciate that the various embodiments of the invention can and may be used in all types of subsurface safety valves, including but not limited to tubing retrievable, wireline retrievable, injection valves, or subsurface controlled valves.

FIG. 1 illustrates a subsurface safety valve assembly 10 placed in a typical well completion schematic 12 in accordance with an embodiment of the invention. A land well is shown for the purpose of illustration; however, it is understood that the subsurface safety valve assembly 10 may also be used in offshore wells. FIG. 1 further illustrates a wellhead 20, a master valve 22, a flow line 24, a casing string 26 and a production tubing 28. In operation, opening the master valve 22 allows pressurized hydrocarbons residing in a producing formation 32 to flow through a set of perforations 34 and into the well 12. Cement seals an annulus 35 between the casing 26 and the production tubing 28 in order to direct the flow of hydrocarbons. Hydrocarbons (illustrated by arrows) flow into the production tubing 28 through the subsurface safety valve assembly 10, through the wellhead 20, and out into the flow line 24.

Figure 2:
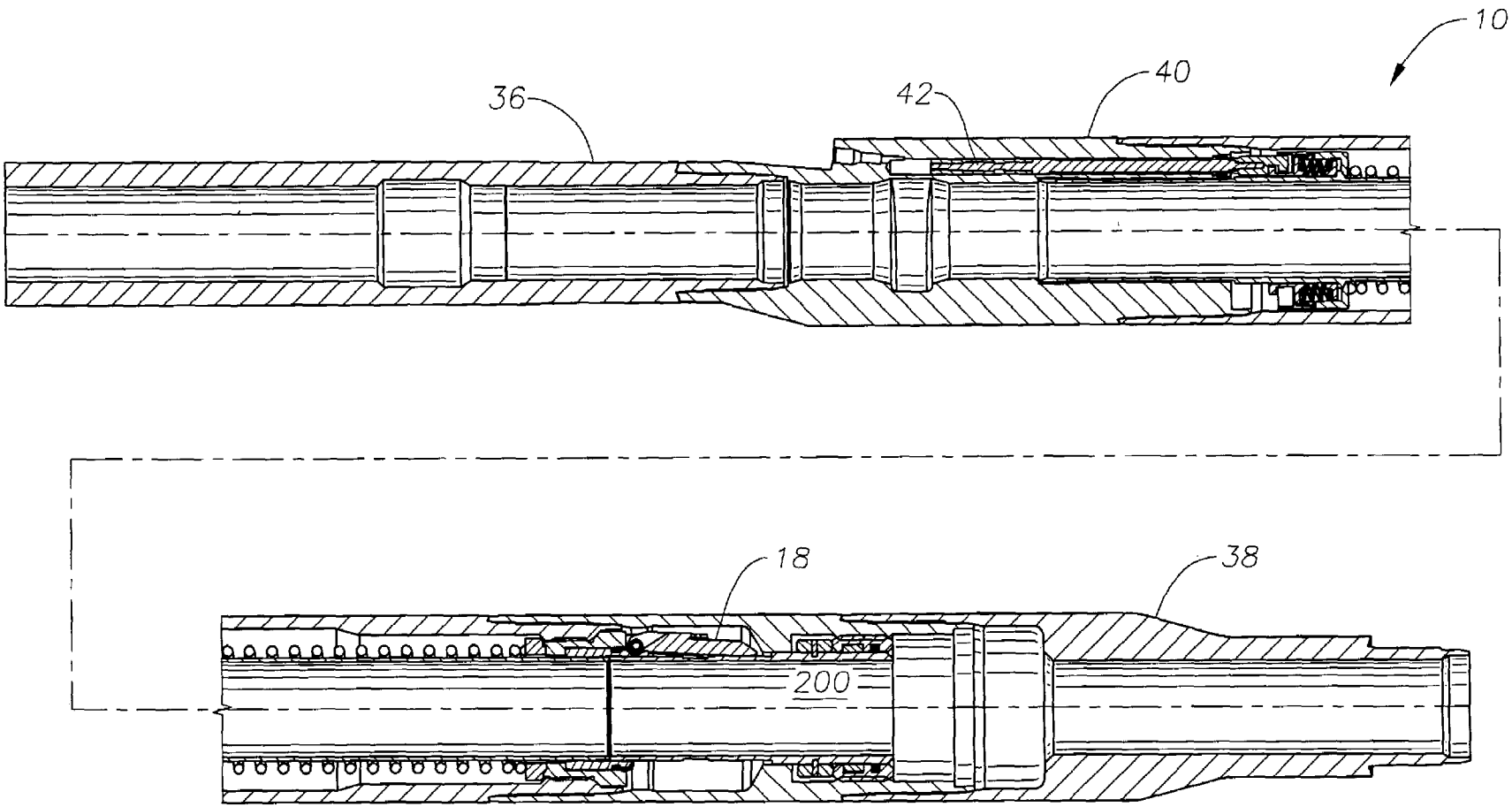
FIG. 2 illustrates a cross-sectional view of the subsurface safety valve assembly in an open position in accordance with an embodiment of the invention.

FIG. 2 illustrates a cross-sectional view of the subsurface safety valve assembly 10 in an open position, i.e., prior to the completion of a cementing operation. An upper nipple 36 and a lower sub 38 serve to sealingly connect the safety valve assembly 10 to the production tubing (not shown). The safety valve assembly 10 is generally maintained in the open position by hydraulic pressure. Hydraulic pressure is supplied by a pump (not shown) in a control panel (not shown) through a control line (not shown) to the safety valve assembly 10. The hydraulic pressure holds a flapper closure mechanism 18 within the safety valve assembly 10 in the open position.

As the safety valve assembly 10 is hydraulically actuated, the safety valve assembly 10 includes a hydraulic chamber housing 40 and a piston 42 therein, as shown in FIG. 2. The piston 42 is typically a small diameter piston which moves within a bore of the housing 40 in response to hydraulic pressure from the surface. Alternatively, the piston 42 may be a large concentric piston which is pressure actuated. It is within the scope of the present invention, however, to employ other less common actuators such as electric solenoid actuators, motorized gear drives and gas charged valves (not shown). Any of these known or contemplated means of actuating the subsurface safety valve assembly 10 of the present invention may be used.

Figure 3:
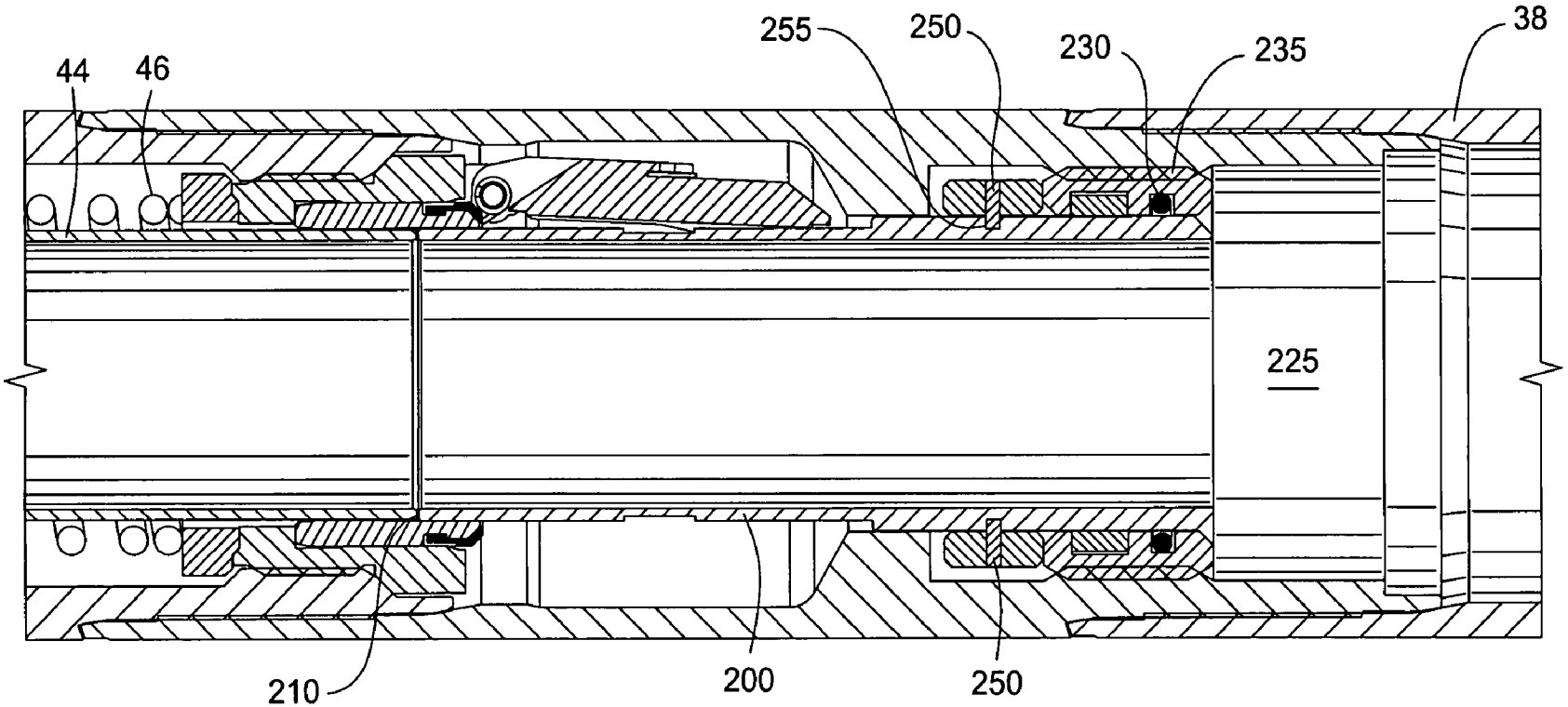
FIG. 3 illustrates a shear sleeve in accordance with an embodiment of the invention in greater detail.

In accordance with an embodiment of the invention, the safety valve assembly 10 further includes a shear sleeve 200. The shear sleeve 200 is configured to eliminate or reduce the amount of cement and/or fluids from entering the safety valve assembly 10. FIG. 3 illustrates the shear sleeve 200 in greater detail. At one end (e.g., the top end), the shear sleeve 200 is positioned against a lower end of the flow tube 44, thereby forming a seal 210 sufficient to keep the cement from entering the safety valve assembly 10. Seal 210 may be formed by pressing the upper end of the shear sleeve 200 against the lower end of a flow tube 44. Seal 210 may be any type of sealing mechanism, such as a metal to metal seal or an elastomeric seal. In one embodiment, a temporary holding mechanism, such as a pin 250, holds the shear sleeve 200 in place at a groove 255 defined on a portion of the outside diameter of the shear sleeve 200. Other temporary holding mechanisms, such as shear screw, collet, and the like, may also be used to hold the shear sleeve 200 in place. In another embodiment, the safety valve assembly 10 further includes a retention sub 225 disposed between the shear sleeve 200 and the lower sub 38. The retention sub 225 has an inside diameter that is larger than an outside diameter of the shear sleeve 200. The larger diameter of the retention sub 225 may be configured to either provide sufficient space for the cement to accumulate or for the movement of the shear sleeve 200 when the flow tube 44 is actuated, which will be described in detail in the following paragraphs. As shown in FIG. 3, the shear sleeve 200 may be coupled to the retention sub 225 by a threaded ring 235 and an o ring 230. The threaded ring 235 may also be used to drive the sleeve 200 against the flow tube 44 to create seal 210.

Figure 4:
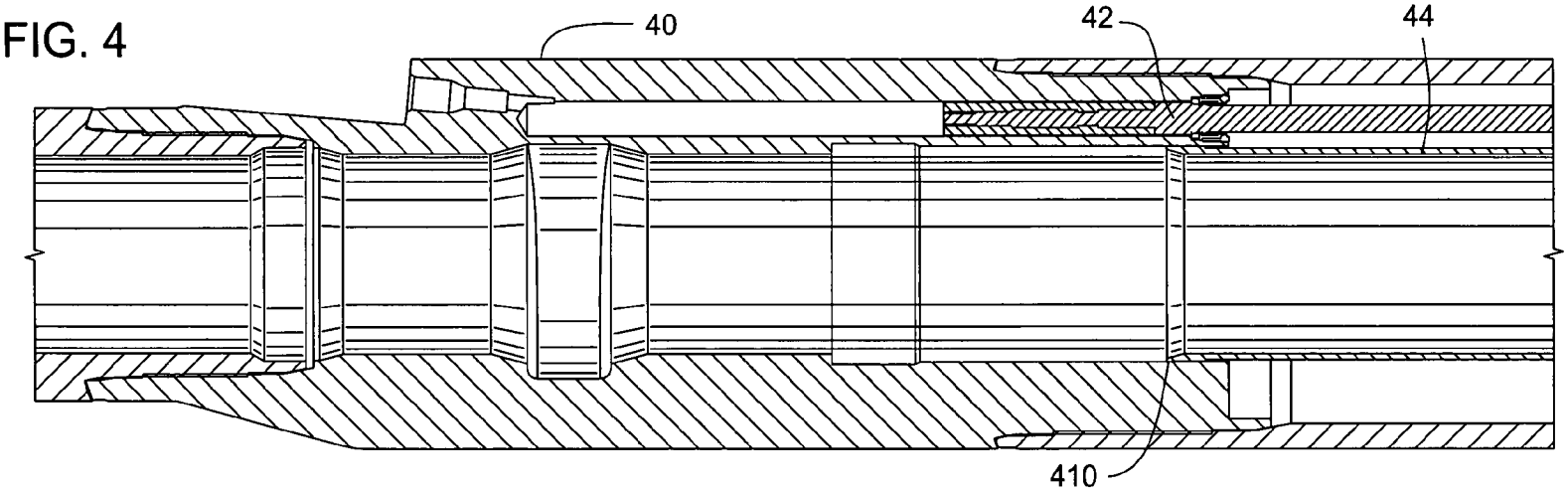
FIG. 4 illustrates a seal formed by a flow tube positioned against a hydraulic chamber housing in accordance with an embodiment of the invention.

In yet another embodiment, an upper end of the flow tube 44 may be positioned, e.g., pressed, against the hydraulic chamber housing 40, thereby forming seal 410, as shown in FIG. 4. Seal 410 is configured to eliminate or reduce the amount of cement entering the top portion of the safety valve assembly 10. Like seal 210, seal 410 may be any type of sealing mechanism, including metal to metal seal or elastomeric seal. In this manner, the shear sleeve 200, in combination with the retention sub 225, seal 210, and seal 410, is configured to substantially eliminate or reduce the amount of cement and/or fluids entering the safety valve assembly 10.

Figure 5:
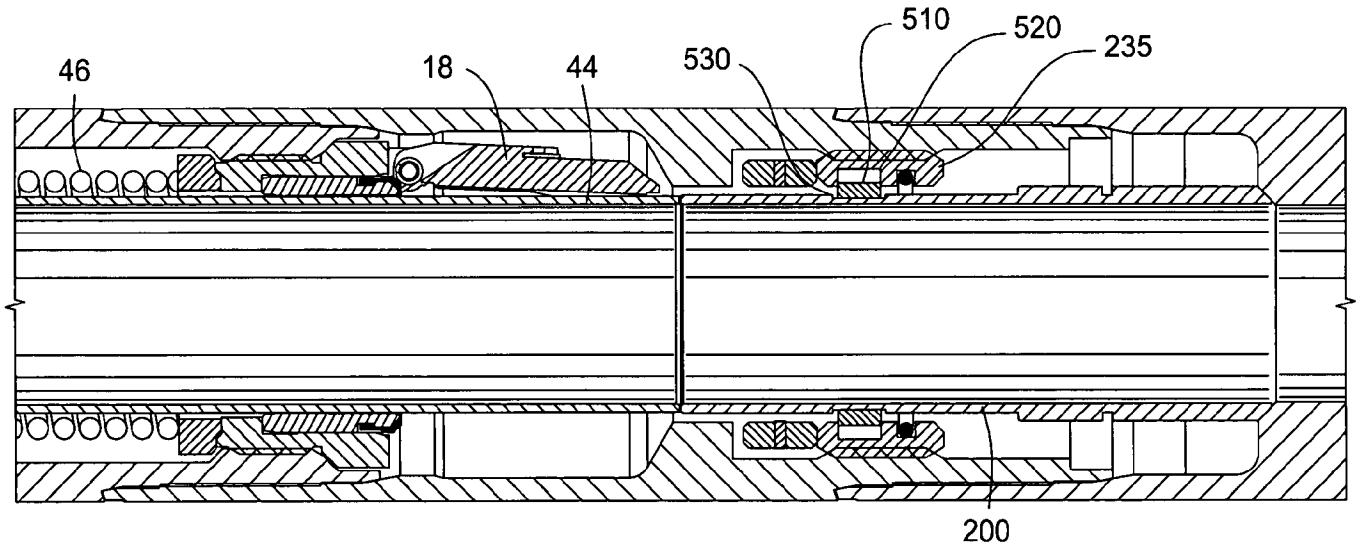
FIG. 5 illustrates the shear sleeve in a position following the completion of a cementing operation in accordance with an embodiment of the invention.

In operation, the safety valve assembly 10 mounted on the production tubing 28 is run into the weilbore prior to the cementing operation. After the cementing operation is complete, the piston 42 is actuated to push the shear sleeve 200 through the retention sub 225 to the lower sub 38. The piston 42 is actuated by application of hydraulic pressure through a control line 16 coupled to a controller 14 (See FIG. 1). The piston 42, in turns, acts upon the flow tube 44, translating the flow tube 44 longitudinally to such an extent that the pin 250 is sheared. The flow tube 44 continues to push the shear sleeve 200 toward the lower sub 38 until a snap ring 510, which was previously disposed in a recess 520 defined inside the threaded ring 235, snaps into a groove 530 defined on the outside diameter of the shear sleeve 200. (See FIG. 5). The snap ring 510 is configured to hold the shear sleeve 200 in place after the flow tube 44 moves the shear sleeve 200 away from the flapper mechanism 18. Other holding mechanisms may also be used to hold the shear sleeve 200 in place after the flow tube 44 moves the shear sleeve 200 away from the flapper mechanism 18. The shear sleeve 200 may be pushed all the way to the bottom of the lower sub 38. In this manner, after the cementing operation is complete, the shear sleeve 200 is shifted to a location that would not interfere with the operation of the safety valve assembly 10, thereby eliminating the need to retrieve the shear sleeve 200 to the well surface. After the shear sleeve 200 is shifted away from the flapper mechanism 18, the pressure (or energy) may be released from the piston 42, thereby causing a power spring 46 to move the flow tube 44 longitudinally upward, allowing the flapper mechanism 18 to close.

Figure 6:
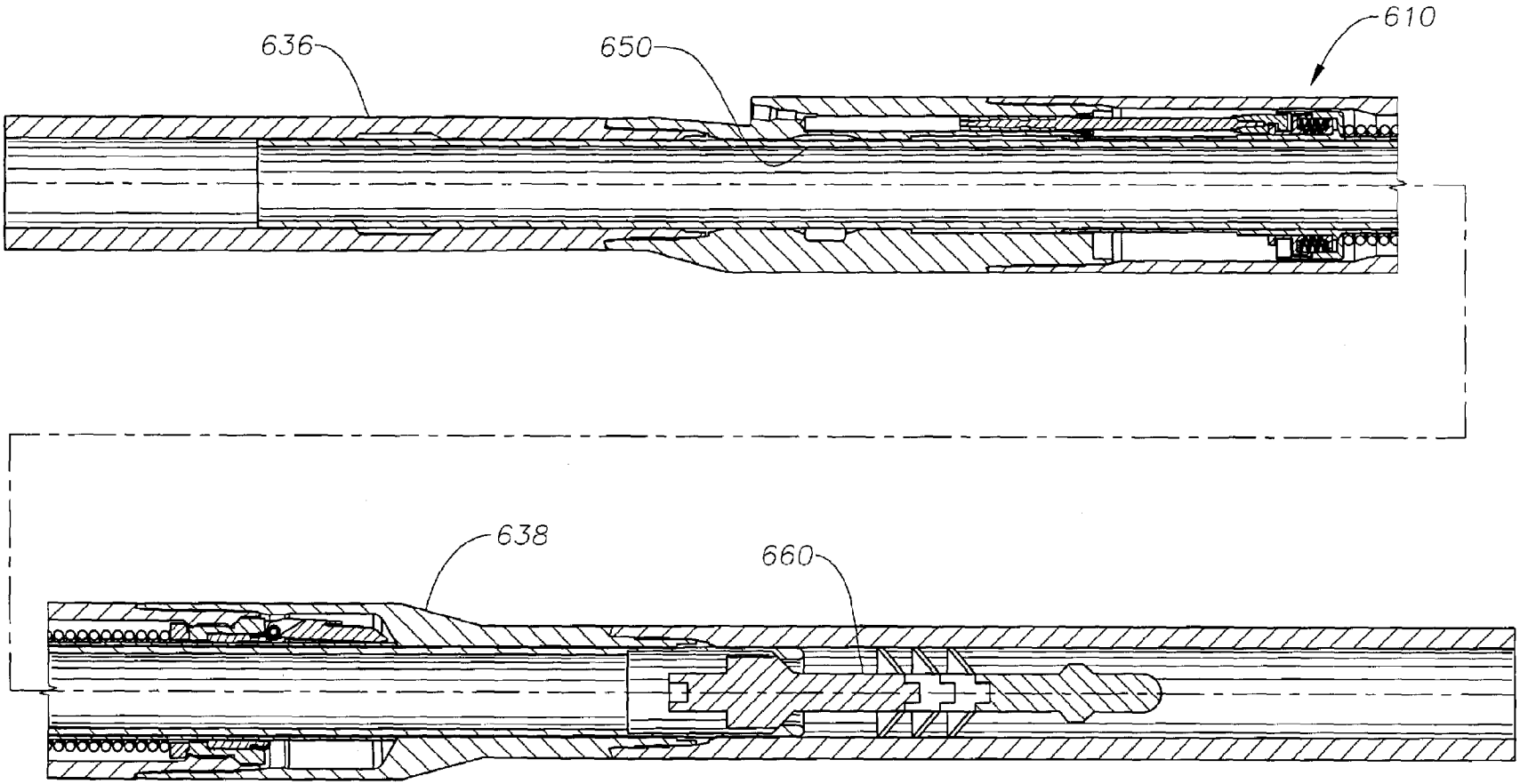
FIG. 6 illustrates a system for protecting well equipment from cement or other fluids during the cementing operation in accordance with an embodiment of the invention.
Figure 7:
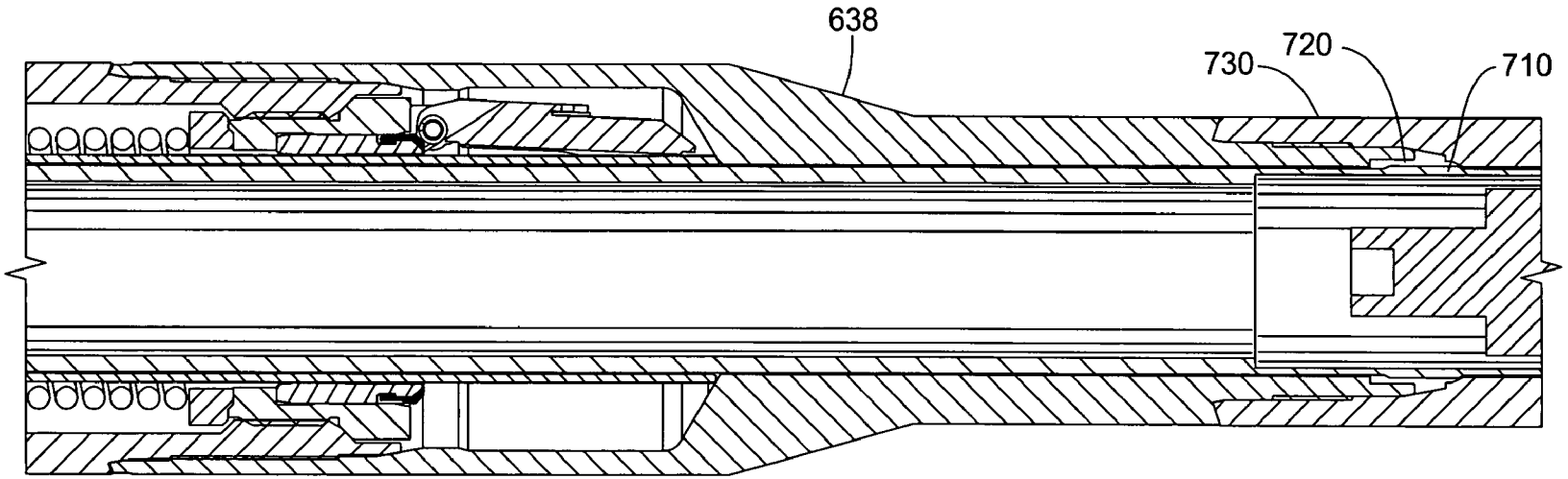
FIG. 7 illustrates the manner in which a sleeve is coupled to a well equipment in accordance with an embodiment of the invention.
Figure 8:
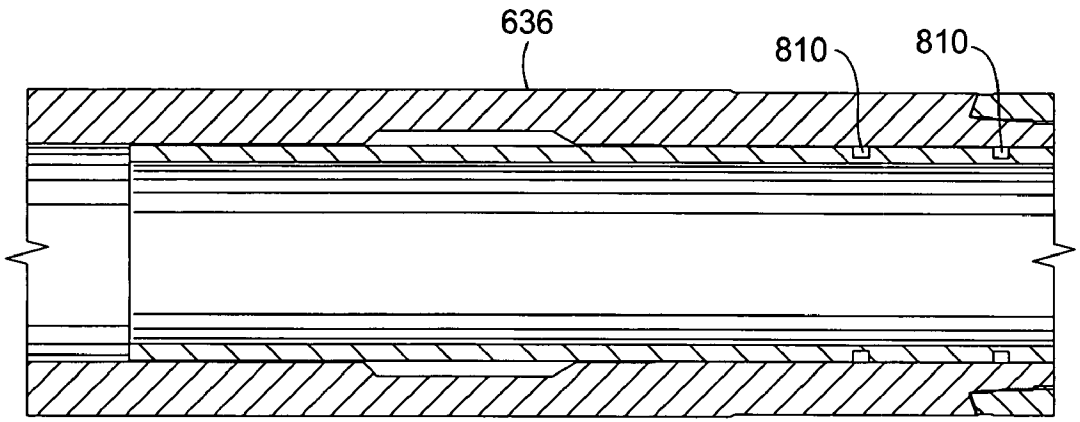
FIG. 8 illustrates o ring grooves defined on the upper nipple in accordance with an embodiment of the invention.

FIG. 6 illustrates another way to protect a safety valve assembly 610 from being infiltrated by cement or other fluids during the cementing operation. That is, FIG. 6 illustrates a cross-sectional view of the safety valve assembly 610 disposed between an upper nipple 636 and a lower sub 638. A sleeve 650 is disposed inside the safety valve assembly 610. The sleeve 650 may be commonly referred to as a hold open sleeve. The sleeve 650 may extend from the upper nipple 636 to the lower sub 638, and beyond. The sleeve 650 may be made from a disposable material, such as, aluminum, plastic, brass, steel and the like. The sleeve 650 includes a collar 710 defined on a portion of the outside diameter of the sleeve 650, as shown in FIG. 7. In one embodiment, the collar 710 is a shear out collar. FIG. 7 further illustrates recess 720 defined on an inside portion of the lower sub 638. The collar 710 and recess 720 are configured to hold the sleeve 650 in place inside the safety valve assembly 610 during the cementing operation. In one embodiment, recess 720 may be defined in an inside portion of a retention sub 730, which is coupled to the lower portion of the lower sub 638. FIG. 8 illustrates that the upper nipple 636 may define o ring grooves 810 configured to provide one or more seals, thereby preventing cement and or other fluids from seeping into the top portion of the safety valve assembly 610.

Figure 9:
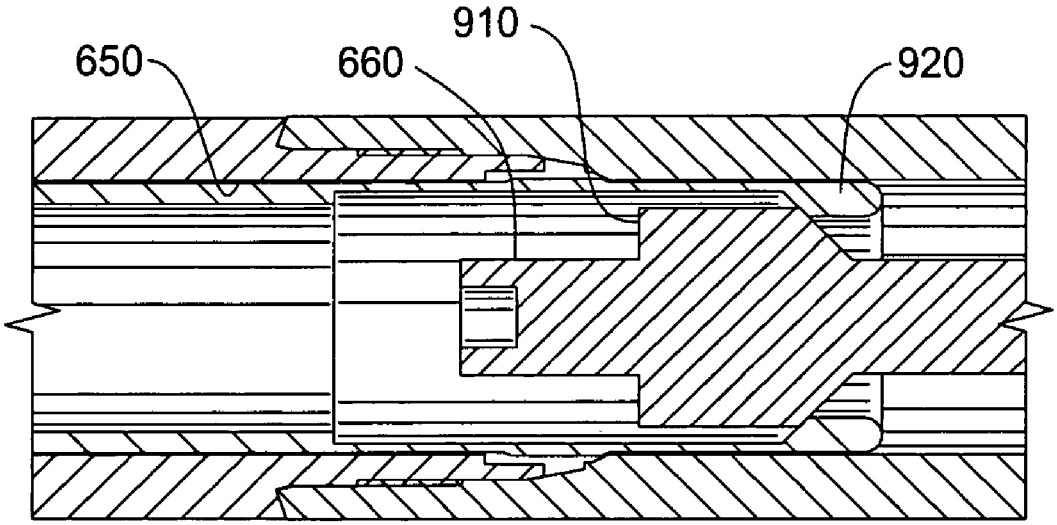
FIG. 9 illustrates the manner in which a dart connects to the sleeve in accordance with an embodiment of the invention.

FIG. 6 further illustrates a dart 660 configured to pull the sleeve 650 away from the safety valve assembly 610 after the cementing operation is complete. An upper outside portion of the dart 660 defines a shoulder 910, as shown in FIG. 9. FIG. 9 also illustrates a lip 920 defined on a portion of the inside diameter of the sleeve 650. The outside diameter of the shoulder 910 is greater than the inside diameter of the lip 920. In this manner, the lip 920 performs as a no go sub, and the shoulder 910 is configured to catch or latch on to the lip 920 when the dart 660 is actuated, which will be described in detail in the following paragraphs.

In operation, the safety valve assembly 610 mounted on the production tubing 28 along with the sleeve 650 are run into the weilbore prior to the cementing operation. During the cementing operation, the sleeve 650 protects the safety valve assembly 610 from the cement or other fluids contained inside the tubing. After the cementing operation is complete, the dart 660 is used to pull the sleeve 650 away from the safety valve assembly 610 to allow the safety valve assembly 610 to operate without any interference from the sleeve 650. In this manner, it is no longer necessary to retrieve the sleeve 650 following completion of the cementing operation. The dart 660 is may be pumped down through the production tubing 28 following the cement as the cementing operation is being completed. The dart 660 is generally actuated or driven by cement completion pumps (not shown). When the sleeve 650 is pulled away, the collar 710 collapses, thereby no longer holding the sleeve 650 inside the safety valve assembly 610. In one embodiment, the sleeve 650 may be pulled all the way down to a rat hole or the bottom of the well. After the sleeve 650 is positioned away from safety valve assembly 610, the safety valve assembly 610 is free to operate in a normal fashion. Following the completion of the cementing operation, the pressure (or energy) may be released from the piston 42, causing the power spring 46 to move the flow tube 44 longitudinally upward, thereby allowing the flapper mechanism 18 to close.

Although the invention has been described in part by making detailed reference to specific embodiments, such detail is intended to be and will be understood to be instructional rather than restrictive. It should be noted that while embodiments of the invention disclosed herein, particularly those embodiments described with reference to FIG. 6 et seq., are described in connection with a subsurface safety valve assembly, the embodiments described herein may be used with any well completion equipment, such as a packer, a sliding sleeve, a landing nipple and the like.

Whereas the present invention has been described in relation to the drawings attached hereto, it should be understood that other and further modifications, apart from those shown or suggested herein, might be made within the scope and spirit of the present invention.

The invention claimed is:

1. An apparatus for controlling fluid flow in a wellbore, comprising:
- a tubular member having a longitudinal bore extending therethrough;
- a flapper mechanism pivotally connected to the tubular member;
- a flow tube disposed inside the tubular member; and
- a shear sleeve disposed inside the tubular member having an upper end and a lower end, wherein the upper end is disposed against a lower end of the flow tube to form a substantial first seal between the upper end of the shear sleeve and the lower end of the flow tube in a first position above the flapper mechanism, and wherein the shear sleeve is held in the first position by a temporary holding mechanism.

2. The apparatus of claim 1, wherein the seal is a metal to metal seal.

3. The apparatus of claim 1, wherein the first position is a run-in position.

4. The apparatus of claim 1, wherein the temporary holding mechanism is a pin extending from the tubular member to a groove defined on an outside portion of the shear sleeve.

5. The apparatus of claim 1, wherein the flow tube is configured to push the shear sleeve to a second position.

6. The apparatus of claim 4, wherein the pin is sheared when the flow tube pushes the shear sleeve to a second position.

7. The apparatus of claim 5, wherein the shear sleeve is pushed to the second position so that the flapper is free to pivot against the tubular member without interference from the shear sleeve.

8. The apparatus of claim 5, wherein the flow tube is actuated by a piston to push the shear sleeve to the second position.

9. The apparatus of claim 5, wherein the shear sleeve is held in the second position by a snap ring that was previously disposed in a threaded ring disposed around the shear sleeve.

10. The apparatus of claim 1, wherein an upper end of the flow tube is positioned against a hydraulic chamber housing disposed in the longitudinal bore to form a substantial second seal therebetween.

11. The apparatus of claim 10, wherein the second seal is a metal to metal seal.

12. The apparatus of claim 1, further comprising:
- a retention sub coupled to a lower portion of the shear sleeve.

13. The apparatus of claim 12, wherein the retention sub defines an inside diameter greater than an outside diameter of the shear sleeve.

14. The apparatus of claim 12, wherein the flow tube is configured to push the shear sleeve through the retention sub to a second position.

15. A system for protecting well completion equipment, the system comprising:

a flapper valve pivotally disposed in a longitudinal bore of a tubing string, the flapper valve maintained in a run-in position by a first tubular member;

a second tubular member abutting the first tubular member to form a first seal to protect the flapper valve from at least one of cement or fluids, wherein the first seal is above the flapper valve in the run-in position, and wherein the first tubular member is retained by a pin extending from the longitudinal bore to a groove defined on an outside portion of the first tubular member.

16. The system of claim 15, further comprising:

a retention sub coupled to a lower portion of the first tubular member, the retention sub having an inner diameter greater than an outer diameter of the first tubular member.

17. The system of claim 16, wherein the second tubular member is configured to push the first tubular member through the retention sub to allow the flapper valve to be maintained in the run-in position by the second tubular member.

18. The system of claim 15, wherein the second tubular member is configured to push the first tubular member to a second position.

19. The system of claim 15, wherein the pin is sheared when the second tubular member pushes the first tubular member to a second position.

20. The system of claim 19, wherein the second tubular member is actuated by a piston to push the first tubular member to the second position.

21. The system of claim 20, wherein the first tubular member is held in the second position by a snap ring that was previously disposed in a threaded ring disposed around the first tubular member.

22. The system of claim 15, wherein an upper end of the second tubular member is positioned against a hydraulic chamber housing disposed in the longitudinal bore to form a second seal therebetween.

23. The system of claim 15, wherein the first seal is a metal to metal seal.

24. The system of claim 22, wherein the second seal is a metal to metal seal.

25. The system of claim 22, wherein the first seal and the second seal is a metal to metal seal.

26. A method of operating a valve in a wellbore, comprising:

locating a valve in the wellbore, the valve comprising:

a first tube;

a second tube;

a metal to metal seal formed by the first and second tube; and a closure member, wherein the seal is located above the closure member and the closure member is retained in an open position by the first tube during the locating;

displacing the first tube from a closure member retaining position by applying a motive force to the second tube; and locating the second tube in the closure member retaining position, thereby retaining the closure member in the open position.

27. The method of claim 26, wherein the motive force is hydraulic pressure supplied to a piston located in the wellbore to maintain the location of the second tube.

28. The method of claim 26, further comprising:

flowing hydrocarbons in a direction towards a wellhead while the closure member is in the open position.

29. The method of claim 26, further comprising:

flowing cement in a direction away from a wellhead while the closure member is in the open position.

30. The method of claim 26, further comprising:

displacing the second tube by discontinuing the motive force applied to the second tube in order to move the closure member to a closed position.

* * * * *